US005132494A

United States Patent [19]

Burton et al.

[11] Patent Number: 5,132,494

[45] Date of Patent: Jul. 21, 1992

[54] DUAL DUROMETER TWIST-ON CONNECTOR

[75] Inventors: Mark A. Burton; Gregg D. Paul; Richard B. Clifton, all of St. Paul, Minn.

[73] Assignee: Minnesota Mining and Manufacturing Company, St. Paul, Minn.

[21] Appl. No.: 663,593

[22] Filed: Mar. 1, 1991

[51] Int. Cl.[5] ..... H01R 4/22; H01R 43/00

[52] U.S. Cl. ..... 174/87; 29/869; 29/872; 439/447

[58] Field of Search ..... 174/87; 439/445, 446, 439/447, 279, 274; 29/868, 869, 872

[56] References Cited

U.S. PATENT DOCUMENTS

| | | | |
|---|---|---|---|
| 2,618,684 | 11/1952 | Bergan | 174/87 |
| 2,656,204 | 10/1953 | Blomstrand | 287/78 |
| 2,756,402 | 7/1956 | Haworth et al. | 439/447 |
| 2,823,249 | 2/1958 | Curtiss | 174/87 |
| 2,823,250 | 2/1958 | O'Keefe | 174/87 |
| 2,890,266 | 6/1959 | Bollmeier | 174/87 |
| 2,925,461 | 2/1960 | Anderson | 174/87 |
| 3,075,038 | 1/1963 | Schinske | 174/87 |
| 3,097,257 | 7/1963 | Cheney | 174/87 |
| 3,107,273 | 10/1963 | Schinske et al. | 174/87 |
| 3,297,816 | 1/1967 | Waddington | 174/87 |
| 3,308,229 | 3/1967 | Burniston | 174/87 |
| 3,448,223 | 6/1969 | Thorsman | 174/87 |
| 3,592,957 | 7/1971 | James | 174/87 |
| 3,665,374 | 5/1972 | Denton | 439/447 |
| 3,676,574 | 7/1972 | Johansson et al. | 174/87 |
| 4,104,482 | 8/1978 | Scott | 174/87 |
| 4,150,251 | 4/1979 | Scott | 174/87 |
| 4,220,811 | 9/1980 | Scott | 174/87 |
| 4,751,350 | 6/1988 | Eaton | 174/87 |
| 4,883,921 | 11/1989 | Legerius et al. | 174/87 |

*Primary Examiner*—Morris H. Nimmo

*Attorney, Agent, or Firm*—Gary L. Griswold; Walter N. Kirn; Jack V. Musgrove

[57] ABSTRACT

A twist-on or wire-nut electrical connector having a rigid, electrically insulative upper body, a flexible, elastic, electrically insulative lower skirt, and a coil spring within the body for gripping wires which may be inserted therein. The provision of a flexible, elastic skirt allows the insertion of a larger number of wires (or larger sized wires) into the connector; the skirt further deforms to fit more easily within a crowded junction box or other high-density wiring environment. Unlike prior art twist-on connectors, the lower skirt is attached directly to the open end of the polymeric body, allowing greater application of torque to the rigid body. In the preferred embodiment, the upper body is formed of polypropylene, the lower skirt is formed of a styrenebutylene compound or an olefinic thermoplastic vulcanizate, and the connector is constructed by multicomponent injection molding.

19 Claims, 1 Drawing Sheet

DUAL DUROMETER TWIST-ON CONNECTOR

BACKGROUND OF THE INVENTION

1. Field of the Invention

The present invention generally relates to electrical connectors, and more particularly to an improved type of connector known as a twist-on or wire-nut connector.

2. Description of the Prior Art

Twist-on connectors (commonly referred to as spring connectors) are well-known in the art. One of the earliest patents disclosing this type of connector is U.S. Pat. No. 2,656,204 issued to J. Blomstrand on Oct. 20, 1953. The Blomstrand connector basically comprises a helically coiled spring, into which twisted wire ends are inserted. As the wire ends are inserted, the coil spring expands slightly and resiliently grips the wire ends. Improved versions of the twist-on connector typically include a hard, electrically insulative shell surrounding the coil spring (such as that shown in U.S. Pat. No. 3,075,038 issued to W. Schinske on Jan. 22, 1963), and the shell often includes integral wing portions (also referred to as ears, tabs, or fins) which allow the user to exert a greater torque while twisting the connector over the wire ends. Minnesota Mining and Manufacturing Company (3M), assignee of the present invention, markets a line of twist-on connectors under the trademarks Scotchlok, Hyflex and Ranger.

One disadvantage inherent in nearly all of the prior art twist-on connectors is the limited range of wire diameters (or absolute number of wires) which the connector can accommodate. As recognized in Underwriters Laboratories' standard 486C for twist-on connectors, this limitation is primarily related to the thickness of the wire insulation. Although a portion of this insulation is removed to allow the wire ends to be twisted together, the insulation must still enter at least slightly into the connector for safety reasons; in other words, no portion of the bare wires should be visible or accessible once the connection is made, to prevent the possibility of a short circuit or other electrical hazard.

FIG. 7 of the Schinske patent suitably illustrates this problem. In many cases, there is sufficient room within the main body of the connector shell (i.e., within the coil spring) to receive multiple wires, but this room often cannot be fully utilized due to the crowding of the wire insulation at the opening of the rigid skirt of the connector. This construction necessarily results in the wasteful use of additional connectors (sometimes requiring "daisy" chains), and in wasted time on the part of the craftsperson making the electrical connections.

One prior art connector which addresses this limitation is shown in U.S. Pat. No. 2,890,266 issued to E. Bollmeier on Jun. 9, 1959. That connector utilizes a metal shell surrounding the coil spring, and an elastic sleeve which surrounds the shell and forms a skirt at the opening of the connector. Bollmeier, however, presents additional problems not present in other prior art connectors. Specifically, it is difficult to exert any torque on the inner metal shell since the sleeve tends to slide around the shell as the connector is twisted over the wires. This drawback may, in some instances, be critical since it affects the integrity of the electrical connection and the pullout force required to remove the wires from the connector.

It is also unproductive to incorporate the wings or tabs of other twist-on connectors into the Bollmeier device since the wings would be integrally formed with the sleeve, which would just exacerbate the tendency of the sleeve to slide around the inner shell. As a further result of the foregoing drawbacks, a user of the connector is required to exert a greater gripping force on the connector, which can deleteriously result in deformation of the inner metal shell and the coil spring. Thus, use of this type of twist-on connector is limited to small wire sizes which require relatively low twisting force to secure the wire bundles. It would, therefore, be desirable and advantageous to devise a twist-on connector having a flexible skirt or opening similar to Bollmeier, but which additionally provides enhanced gripping action and greater torque application, to insure a secure wire connection, and which further accommodates a wider range of wire gauges.

SUMMARY OF THE INVENTION

The foregoing objectives are achieved in a dual durometer twist-on connector having a rigid, insulative upper body, and a flexible skirt attached to the upper body, the skirt preferably also being elastic. A coil spring is mounted within the internal bore of the upper body to resiliently grip wires which are inserted therein. In this manner, the connector may be used to connect a wider range of wire gauges (or to connect a larger number of wires) since the skirt can expand to accommodate the bulky insulation surrounding the wires. Unlike the prior art connectors, however, the use of a flexible skirt does not interfere with manual application of the connector and, furthermore, the use of a rigid, insulative upper body allows direct attachment of torque-application wings. The invention also contemplates various processes used to bond the skirt to the rigid body.

BRIEF DESCRIPTION OF THE DRAWINGS

The novel features and scope of the invention are set forth in the appended claims. The invention itself, however, will best be understood by reference to the accompanying drawings, wherein:

DESCRIPTION OF THE PREFERRED EMBODIMENT

Figure 1:
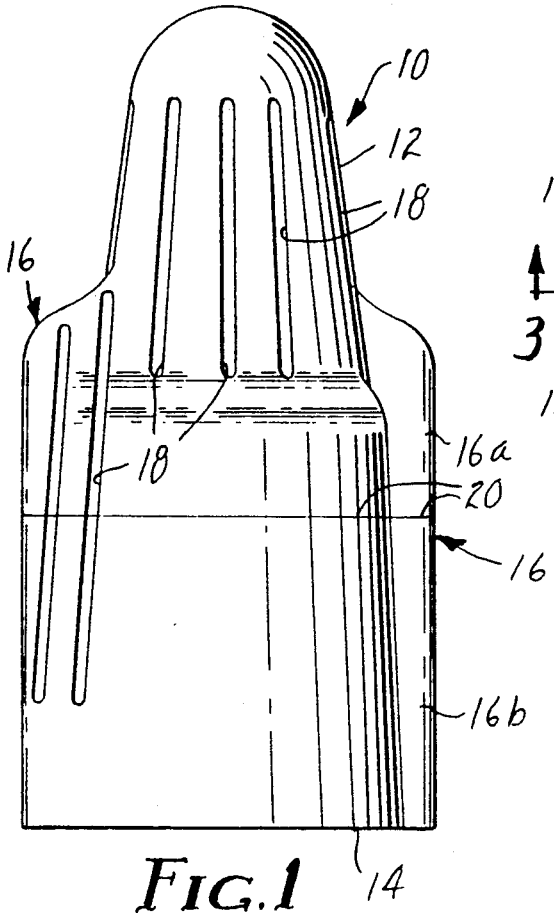
FIG. 1 is a side elevational view of the dual durometer twist-on connector of the present invention.
Figure 2:
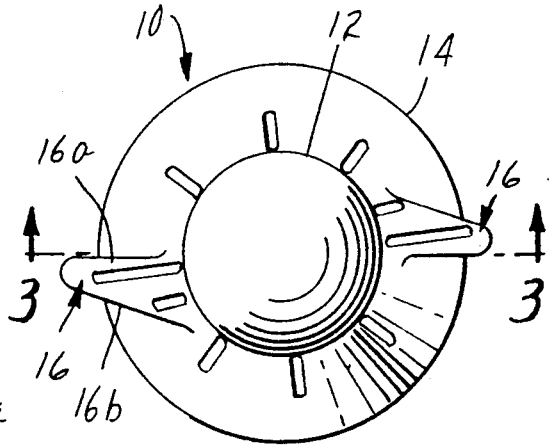
FIG. 2 is a top plan view of the dual durometer twist-on connector of the present invention.

With reference now to the figures, and in particular with reference to FIGS. 1 and 2, there is depicted the dual durometer twist-on connector 10 of the present invention. Connector 10 is generally comprised of an upper shell or body 12 and a lower skirt 14. Upper body 12 is constructed of any rigid, electrically insulative material, preferably a durable polymer such as polypropylene, polyethylene, or hard vinyl or polyvinyl chloride. A polycarbonate/polybutylene terephthalate alloy may also be used, such as that sold by General Electric Plastics under the brand name XENOY. Body 12 should have a Rockwell hardness of at least R50, allowing high torque application.

Lower skirt 14 is constructed of any flexible, electrically insulative material, preferably an elastic polymer such as styrene-butadiene-styrene (SBS), styrene-ethylene-butylene, acrylonitrile-butadiene-styrene, styrene-acrylonitrile, ethylene-propylene diene terpolmer (EPDM), polychloroprene, copolyester elastomers, modified plastisols, or plasticized vinyl. The preferred materials for skirt 14 are SANTOPRENE (a trademark of Advanced Elastomer Systems of Akron, Ohio), which is an olefinic thermoplastic vulcanizate, and ELEXAR (a trademark of Shell Chemical Co. of Houston, Tex.), which is a styrene-ethylene/butylene-styrene compound. This list is not meant to be exhaustive, and other elastomers, as well as natural and synthetic (e.g., urethane or silicone) rubbers, may be used for skirt 14. As explained further below, skirt 14 is advantageously constructed of a material which bonds well with the material selected for body 12. The softness of the material selected for skirt 14 depends upon the thickness of skirt 14 (discussed further below), but the acceptable durometer range is about Shore A 18 to Shore D 75.

Also visible in FIGS. 1 and 2 are wings 16 (sometimes referred to as ears, tabs, fins, or extensions) which, as explained further below, are preferably formed integrally with upper body 12 and skirt 14. Wings 16 extend away from body 12 in a slightly skewed fashion to facilitate clockwise rotation of connector 10 (as viewed in FIG. 2) Which forces the wires to become further twisted together. Wings 16 may be modified, e.g., by making them retractable as shown in U.S. Pat. No. 3,308,229 (Burniston), or by making them frangible or breakaway as shown in copending U.S. patent application Ser. No. 07/561,699 (filed Aug. 2, 1990). The outer surface of body 12 (as well as the work surface of wings 16) is also provided with a plurality of longitudinal grooves 18 which allow stronger gripping for better application of torque.

Figure 3:
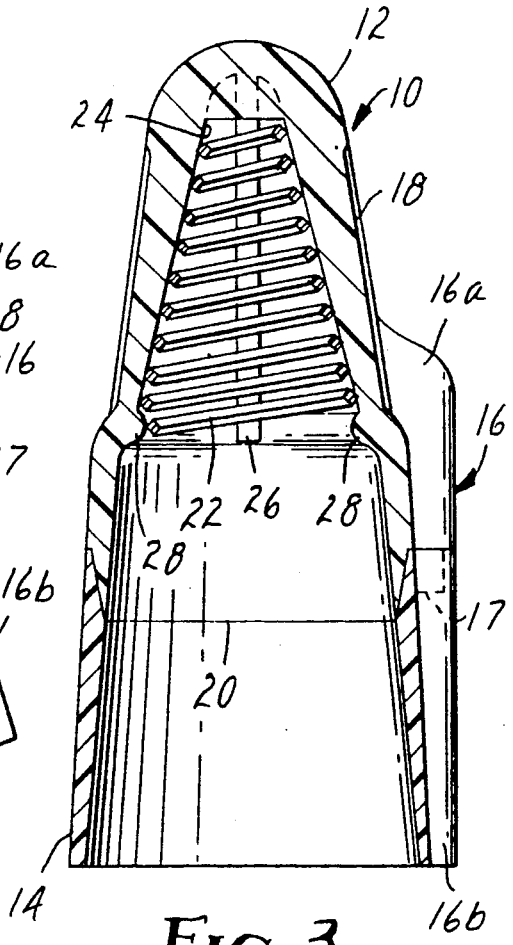
FIG. 3 is an elevational cross-section taken along lines 3—3 of FIG. 2.

Referring now to FIG. 3, connector 10 is depicted in cross-section along lines 3—3 of FIG. 2. FIG. 3 shows more clearly the two part construction of connector 10 (i.e., upper body 12 and lower skirt 14), and the generally tubular construction of both body 12 and skirt 14. In this regard, it is understood that the term "tubular" is not limited to objects having a circular cross-section, but rather denotes a hollow member of any cross-section. Body 12 has a closed end and an open end, the open end being bonded to or integrally formed with an open end of skirt 14 at a seam or interface 20 (explained further below).

FIG. 3 further illustrates a coil spring 22 located within an internal bore 24 of body 12. The inner surface of internal bore 24 preferably has a frusto-conical shape, and coil spring 22 is accordingly wound in increasingly smaller diameters to fit snugly within bore 24. Longitudinal vanes or ribs 26 may be attached to the inner surface of bore 24 to provide some tolerance for minor expansions or deformations of spring 22 and yet still keep spring 22 centered within bore 24. In the preferred embodiment, there are four such ribs 26 which are molded integrally with body 12, two of these ribs being shown in cross-section in FIG. 3.

Coil spring 22 is preferably formed of cold-rolled steel, and has a square cross-section. In this manner, the inwardly extending edge or corner of the spring contacts and work-hardens the wires which are inserted into connector 10. Coil spring 22 is retained within internal bore 24 of body 12 by an annular flange or rim 28 formed integrally with body 12. Coil spring 22 may be modified as desired, e.g., by providing dilatable convolutions as taught by Burniston, or by providing an hourglass-shaped coil spring as taught in U.S. Pat. No. 3,676,574 (Johansson et al.). Coil spring 22 may also be replaced by other resilient means for gripping the inserted wires, such as a threaded metal retainer as shown in U.S. Pat. No. 4,150,251 (Scott).

Those skilled in the art will appreciate that the attachment between body 12 and skirt 14 must be sufficiently strong to withstand the stress and shearing forces which are transferred to skirt 14 across interface 20 as body 12 is twisted around the inserted wires. Proper attachment of skirt 14 to body 12 depends on several factors, including the method of assembly, material selection, and the mechanical fit at the interface. The preferred method of joining skirt 14 to body 12 is multicomponent injection molding, also referred to as dual injection molding or two-color molding (not to be confused with co-injection). Of course, other methods are acceptable, including insert molding, ultrasonic welding, solvent welding, or the simple application of an adhesive at interface 20. Multicomponent injection molding is preferred inasmuch as it requires minimal handling of components.

Multicomponent injection molding is also advantageous since there are several materials which can be used in that process and which are suited for use in the dual durometer connector of the present invention. Specifically, the preferred material for body 12, polypropylene, is easy to form via multicomponent injection molding. The preferred material for skirt 14 is accordingly chosen for its ability to adhere to polypropylene and to be injection molded. Experimentation has revealed that butylene and butadiene compounds bond well to polypropylene and may be used with multicomponent injection molding (see above for the recitation of specific materials for skirt 14). It does not matter whether body 12 or skirt 14 is formed in the first mold operation; however, the first component of connector 10 which is molded should preferably still be warm when the second component is molded against it. This will result in an improved bond at interface 20. In multicomponent injection molding, the two components are molded relatively quickly and thus the first component is still warm when the second material is injected into the mold.

The strength of the bond between body 12 and skirt 14 may be maximized by increasing the surface area which forms interface 20. Therefore, in the multi-component injection process, the molds are fabricated in such a manner that the connective ends of body 12 and skirt 14 form a tapered hem or margin providing overlapping surfaces at interface 20. Based on the exemplary dimensions of connector 10 given further below, the width of the overlapping sections is about 5.3 mm. These overlapping surfaces may further be contoured, embossed or otherwise treated to increase the effective area of contact between body 12 and skirt 14, resulting in stronger joint.

FIG. 3 also illustrates more clearly the two-segment nature of wings 16. The upper portion **16*a* is molded integrally with body 12 while the lower portion 16*b* is molded integrally with skirt 14. Upper wing segment 16*a* also preferably includes a tab portion 17 extending downward. Lower wing segment 16*b* is molded completely around tab 17**, providing an interlocking fit between the two segments.

The actual dimensions of connector 10 may vary considerably depending upon the intended usage. The dual durometer connector could be as long as five centimeters, or as short as one centimeter. Moreover, connector 10 has a wider range of application due to the previously discussed advantages, and a given connector 10 of known dimensions can actually be used in lieu of two or more prior art connectors of different sizes.

By way of example, it is useful to note that prior art twist-on connectors come in certain standard sizes which are conventionally color coded. A yellow connector, for instance, typically has an overall length of about 2¾ centimeters and a maximum diameter of just less than one centimeter at its opening; the smallest pair of wires this connector will hold is 18 gauge, while it accommodates a maximum of three 12 gauge wires (this is true of 3M's yellow Scotchlok TM connector). A red connector typically has an overall length of about 3 centimeters and a maximum diameter of about 1.3 centimeters at its opening; the smallest pair of wires that such a red connector will hold is 16 gauge, while it accommodates a maximum of five 12 gauge wires (this range applies to 3M's red Ranger TM connector). Both of these prior art connectors, however, may be effectively replaced by a single connector of the present invention having an approximate overall length of 3.6 centimeters, a maximum diameter of about 1.5 centimeters at the opening of skirt 14, and an intermediate diameter of about one centimeter at annular rim 28. Experimentation has shown that a dual durometer connector having these dimensions will still accommodate up to five 12 gauge wires, but will further retain a pair of wires as small as 22 gauge. Thus, a dual durometer connector having these dimensions actually provides a wider range of application than the combined ranges of conventional yellow and red connectors. Such a connector could conveniently be color-coded by coloring one component (e.g., body 12) red and coloring the other component (e.g., skirt 14) yellow.

The thickness of skirt 14 may also vary depending upon its desired flexibility, elasticity and overall strength. As previously mentioned above, a very soft material (shore A 18) may be used, in which case skirt 14 should be about 30/1000" (0.76 mm) thick. Alternatively, a more durable material may be used (up to about shore D 75), in which case skirt 14 could be as thin as about 10/1000" (0.25 mm). In the preferred embodiment, skirt 14 is constructed from a material having a hardness of about shore A 90, and is molded to have a minimum thickness of about 20/1000" (0.51 mm).

Figure 4:
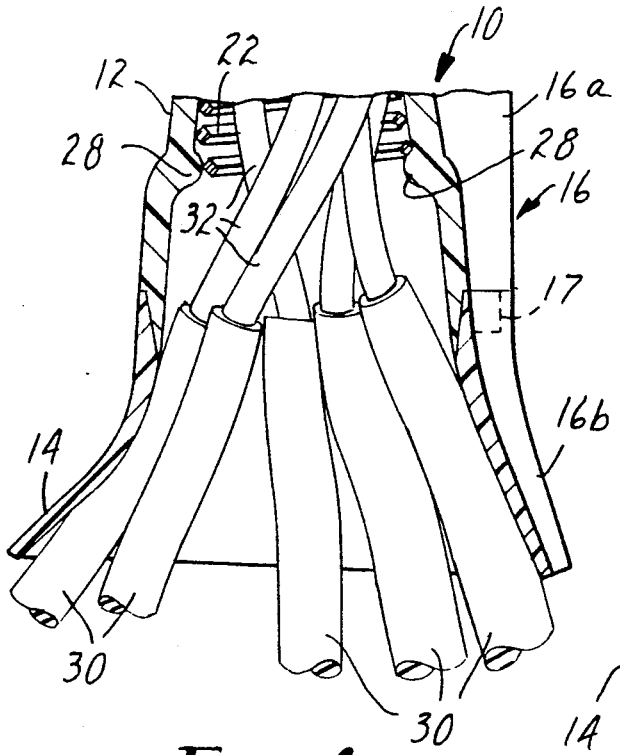
FIG. 4 is a cross-section similar to FIG. 3, but further depicting a plurality of wires inserted into the connector.

The advantages of dual durometer connector 10 may best be understood with reference to FIG. 4. That figure is similar to FIG. 3 except it additionally shows the insertion of several wires 30. The terminal portions of wires 30 have been stripped, exposing the conductors 32 which are twisted together and inserted within coil spring 22. As connector 10 is twisted about wires 30, coil spring 22 expands slightly, and maintains a spring pressure against wires 30. It would be difficult or impossible to insert this many wires (five are depicted in FIG. 4) into a prior art connector, due to the crowding of the bulky insulation surrounding conductors 32. Dual durometer connector 10, however, easily accommodates a larger number of wires (or wires of a larger size) because skirt 14 may flex to better conform around wires 30, and skirt 14 may further expand due to its elastic properties. The friction fit of skirt 14 around wires 30 also provides strain relief, i.e., makes it more difficult to pull wires 30 out of connector 10.

Connector 10 has a further advantage relating to the limited amount of space available in most high density wiring environments. If only two or three wires are connected therein, connector 10 may still be located in a crowded junction box and skirt 14 will not displace extra volume or otherwise interfere with surrounding components since it may deform to optimally fit among other connectors in the junction box.

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. It is therefore contemplated that the appended claims will cover such modifications that fall within the true scope of the invention.

We claim:

1. An article for connecting two or more wires together, comprising:

a rigid, electrically insulative body having an internal bore, a closed end, and an open end;

means located within said internal bore for resiliently gripping wires which may be inserted therein; and a flexible, electrically insulative, generally tubular skirt member having first and second open ends, said first end being attached to said open end of said rigid body, said skirt member being constructed from a material having a durometer in the range of Shore A 18 to Shore D 75.

2. The article of claim 1 wherein said skirt member is formed from an elastic material.

3. The article of claim 1 wherein said rigid body is constructed from a material having a Rockwell hardness of at least R50.

4. The article of claim 1 wherein said rigid body is formed from a material selected from the group consisting of polypropylene, polyethylene, polycarbonate/polybutylene terephthalate, hard vinyl, and polyvinyl chloride.

5. The article of claim 1 wherein said flexible skirt member is formed from a material selected from the group consisting of styrene-butadiene-styrene, styrene-ethylene-butylene, styrene-ethylene/butylene-styrene, acrylonitrile-butadiene-styrene, styrene-acrylonitrile, ethylene-propylene diene terpolmer (EPDM), polychloroprene, copolyester elastomers, plasticized vinyl, olefinic thermoplastic vulcanizates, and modified plastisols.

6. The article of claim 1 wherein said rigid body includes integrally formed wing means for applying torque to said body.

7. The article of claim 1 wherein said open end of said body terminates in a tapered margin, and said first end of said skirt member terminates in a tapered margin, said margins overlapping and forming a bond which attaches said body to said skirt member.

8. An electrical connector comprising:

a body having a closed end, an open end, and an internal bore defining a frusto-conical cavity, said body formed from a rigid, electrically insulative polymer;

a helically wound coil spring inserted in said internal bore of said body; and a tubular skirt attached to said open end of said body, said skirt formed from a flexible, elastic, electrically insulative polymer.

9. The connector of claim 8 wherein said body has a Rockwell hardness of at least R50, and said rigid polymer is selected from the group consisting of polypropylene, polyethylene, polycarbonate/polybutylene terephthalate, hard vinyl, and polyvinyl chloride.

10. The connector of claim 8 wherein said skirt has a durometer in the range of Shore A 18 to Shore D 75, and said flexible, elastic polymer is selected from the group consisting of styrene-butadiene-styrene, styrene-ethylene-butylene, styrene-ethylene/butylene-styrene, acrylonitrile-butadiene-styrene, styrene-acrylonitrile, ethylene-propylene diene terpolmer (EPDM), polychloroprene, copolyester elastomers, plasticized vinyl, olefinic thermoplastic vulcanizates, and modified plastisols.

11. The connector of claim 8 wherein said body has an outer surface, and further comprising a pair of wing extensions attached to said outer surface of said body, said outer surface further having a plurality of longitudinal grooves therein.

12. The electrical connector of claim 8 wherein said body includes:

a plurality of longitudinal ribs extending into said internal bore, in contact with said coil spring; and an annular rim extending into said internal bore, proximate said open end of said body, for retaining said coil spring in said internal bore.

13. A twist-on electrical connector consisting essentially of:

a body having a closed end, an open end, and an internal bore, said body formed from a rigid, electrically insulative polymer;

means located within said internal bore for resiliently gripping wires which may be inserted therein; and a tubular skirt attached to and integral with said open end of said body, said skirt formed from a flexible, elastic, electrically insulative polymer.

14. A method of manufacturing an electrical connector, comprising the steps of:

forming a body from a rigid, electrically insulative polymer, said body having a closed end, an open end, and an internal bore, said open end terminating in a tapered margin;

fabricating a tubular skirt from a flexible, electrically insulative polymer, said skirt having first and second open ends, said first end terminating in a tapered margin;

bonding said tapered margin of said open end of said body to said tapered margin of said first end of said skirt; and inserting, within said internal bore of said body, means for resiliently gripping wires which may be placed in said internal bore.

15. The method of claim 14 wherein said forming, fabricating, and bonding steps are performed using multicomponent injection molding.

16. The method of claim 14 wherein said forming, fabricating, and bonding steps are performed using insert molding.

17. The method of claim 14 wherein said bonding step is performed by ultrasonic welding.

18. The method of claim 14 wherein said bonding step is performed by solvent welding.

19. The method of claim 14 wherein said bonding step is performed by applying an adhesive at an interface between said tapered margin of said open end of said body and said tapered margin of said first end of said skirt.

* * * * *